US005740320A

United States Patent [19]

Itoh

[11] Patent Number: 5,740,320

[45] Date of Patent: Apr. 14, 1998

[54] TEXT-TO-SPEECH SYNTHESIS BY CONCATENATION USING OR MODIFYING CLUSTERED PHONEME WAVEFORMS ON BASIS OF CLUSTER PARAMETER CENTROIDS

[75] Inventor: Kenzo Itoh, Yokosuka, Japan

[73] Assignee: Nippon Telegraph and Telephone Corporation, Tokyo, Japan

[21] Appl. No.: 852,705

[22] Filed: May 7, 1997

Related U.S. Application Data

[63] Continuation of Ser. No. 207,424, Mar. 8, 1994, abandoned.

[30] Foreign Application Priority Data

Mar. 10, 1993 [JP] Japan ..... 5-049321

[51] Int. Cl.[6] ..... G10L 5/04

[52] U.S. Cl. ..... 395/2.76; 395/2.69; 395/2.71; 395/2.77; 395/2.76

[58] Field of Search ..... 395/2.69, 2.71, 395/2.76, 2.77

[56] References Cited

U.S. PATENT DOCUMENTS

| | | | |
|---|---|---|---|
| 3,892,919 | 7/1975 | Ichikawa | 395/2.76 |
| 4,577,343 | 3/1986 | Oura | 395/2.67 |
| 5,204,905 | 4/1993 | Mitome | 395/2.69 |
| 5,327,498 | 7/1994 | Hamon | 395/2.77 |
| 5,490,234 | 2/1996 | Narayan | 395/2.69 |

OTHER PUBLICATIONS

Jonathan Allen, "Overview of Text-to-Speech Systems", chapter 23 in Advances in Speech Signal Processing, edited by Sadaoki Furui and M. Mohan Sondhi, Marcel Dekker, Inc., 1991.

Mark Y. Liberman and Kenneth W. Church, "Text Analysis and Word Pronunciation in Text-to-Speech", chapter 24 in Advances in Speech Signal Processing, edited by Sadaoki Furui and M. Mohan Sondhi, Marcel Dekker, Inc., 1991.

Hirokazu Sato, "Speech Synthesis for Text-to-Speech Systems", chapter 25 in Advances in Speech Signal Processing, edited by Sadaoki Furui and M. Mohan Sondhi, Marcel Dekker, Inc., 1991.

Douglas O'Shaughnessy, "Approaches to Improve Automatic Speech Synthesis", chapter 14 in Modern Methods of Speech Processing, edited by Ravi P. Ramachandran and Richard J. Mammone, Kluwer Academic Publishers, 1995.

Nakajima et al., "Automatic Generation of Synthesis Units Based on Context Oriented Clustering", ICASSP, New York, pp. 659-662, Apr. 1988.

*Primary Examiner*—Allen R. MacDonald
*Assistant Examiner*—Tālivaldis Ivars Smits
*Attorney, Agent, or Firm*—Pollock, Vande Sande & Priddy

[57] ABSTRACT

In a waveform compilation (waveform concatenation or synthesis-by-rule) type speech synthesis method and speech synthesizer, phoneme waveform segments in natural speech waveforms are clustered, and one of the phoneme waveform segments having a parameter nearest the centroid of LPC parameters of all the phoneme waveforms in each cluster is selected and stored as a representative phoneme waveform in a waveform information memory. When synthesizing a speech waveform, representative phoneme waveforms of the same phonemes, whose context is most similar to that of each phoneme of a phoneme string of the speech to be synthesized, are selectively read out of the waveform information memory and thus read-out representative phoneme waveforms are sequentially concatenated for output as a continuous synthesized speech waveform.

18 Claims, 8 Drawing Sheets

TEXT-TO-SPEECH SYNTHESIS BY CONCATENATION USING OR MODIFYING CLUSTERED PHONEME WAVEFORMS ON BASIS OF CLUSTER PARAMETER CENTROIDS

This application is a continuation of U.S. patent application Ser. No. 08/207,424, filed Mar. 8, 1994 now abandoned.

BACKGROUND OF THE INVENTION

The present invention relates to a waveform compilation type speech synthesizer which is applied to a device for synthesizing desired speech according to specific rules and which sequentially concatenates selected one of a number of prepared speech waveform segments (synthesis units) to synthesize desired speech.

In the conventional compilation type speech synthesis systems in which various speech synthesis units obtained from standard speech waveforms are prestored and speech synthesis units read out of storage are concatenated in succession to synthesize a sequence of speech, it has been proposed to provide (a) a waveform compilation (waveform concatenation or synthesis-by-rule) type speech synthesis system in which speech synthesis units prestored as phoneme waveforms are selectively read out and concatenated to synthesize a sequence of speech, and (b) a parameter compilation (analysis-synthesis or source-filter) type speech synthesis system in which acoustic parameters, obtained as by LPC analysis of such phoneme waveforms, are stored, selectively read out speech-synthesized and used to control a filter to synthesize speech. At any rate, to generate high quality synthesized speech or voice close to natural speech, the speech analysis-synthesis system, speech unit selection method and various acoustic parameter control rules, which are used therefor, are of importance.

Many conventional speech analysis-synthesis (source-filter or parameter compilation) methods employ a PARCOR system and an LSP system (U.S. Pat. No. 4,393,272) based on linear predictive analysis (LPC analysis) which provides excellent controllability of acoustic feature parameters of speech. In these conventional systems, a speech signal waveform is subjected to LPC analysis with a fixed time width (about 30 ms, for example, and called an analysis window) to obtain acoustic parameters (such as voiced and unvoiced sounds discriminating information, power, pitch frequency and LPC parameters) and this LPC analysis is repeated while shifting the analysis window every fixed period of time (5 to 10 ms, for example, and called a frame). In the speech synthesis the acoustic parameters thus obtained by the LPC analysis are used to generate, as an excitation signal, noise in the unvoiced part and a pulse train of the detected pitch in the voiced part, and a synthesis filter, which has its coefficients controlled by the LPC parameters (representing the power spectrum envelope of the speech waveform in the window), is excited by the excitation signal to output synthesized speech.

The application of this LPC synthesis scheme to the above-mentioned compilation type speech synthesis system is disclosed in, for example, Nakajima et al, "Automatic Generation of Synthesis Units Based on Context Oriented Clustering", PROCEEDING FROM ICASSP-INTERNATIONAL CONFERENCE ON Acoustics, Speech, and Signal Processing, New York, N.Y., Apr. 11–14, 1988. In the Nakajima et al. method, natural speech waveforms of large quantities of standard texts by speech as long as two hours, for example, are sequentially partitioned into phoneme segments, which are each provided with a label representing the kind of its phoneme and then stored in a database, and phoneme waveforms read out therefrom are sequentially subjected to LPC analysis for each phoneme segment. Data of LPC parameter matrixes thus obtained for respective phoneme waveforms are each classified (i.e. clustered) according to a combination of preceding and succeeding phonemes of the same cluster, that is, according to the noted phoneme and its phonetic context, and the centroid matrix of LPC parameter matrixes of all phoneme waveforms belonging to the same cluster is calculated as a representative LPC parameter matrix of the cluster. Such centroid LPC parameter matrixes, each representing the cluster of phoneme waveforms of the same context, are stored in a memory corresponding to the respective clusters. To synthesize speech from a text, respective phonemes in the text and the representative LPC matrixes corresponding to the phoneme contexts are sequentially read out from the memory and provided as filter coefficients to the LPC speech synthesis filter for speech synthesis.

When the LPC parameter matrix is used to synthesize speech as mentioned above, the LPC parameter matrix necessary for generating respective synthesis phoneme segments can be obtained simply by calculating the centroid matrix of the LPC parameter matrixes of the phoneme waveforms in the respective cluster, and the resulting speech synthesized using such a centroid matrix has a waveform appropriately representing the phoneme. Hence, the LPC speech synthesis is suitable for use with the method which determines the representative parameter matrix in the cluster through calculation. Yet, this LPC analysis system (the PARCOR system and the LSP system are also included in the LPC analysis method) is intended primarily to compress the amount of information, and since a sound source signal for driving the speech synthesis filter is produced by a combination of a simple pulse generator and a noise generator, the analyzed-synthesized sound obtainable in the compilation type speech synthesis system using the LPC parameters becomes a mumbling sound, which is an unnatural sound bearing little resemblance to a natural voice.

On the other hand, in what is called a waveform compilation (waveform concatenation or synthesis-by-rule) type speech synthesis system used heretofore, waveforms of natural speech uttered by reading a large quantity of standard text are stored in a database memory and the speech waveforms are partitioned into phoneme segments, which are labeled. When a given text is synthesized into speech, phoneme waveforms corresponding to respective phonemes in the text are selected as speech synthesis units from the database memory in accordance with combinations of the kinds of phonemes and their phonetic contexts and are concatenated one after another. In this instance, since the phoneme waveforms that are read out as speech synthesis units from the database memory are natural speech waveforms, even if they are clustered as mentioned above and the centroid of each cluster is obtained as a waveform in the time domain, not as the LPC parameter matrix, it is only to average the waveform—this may degrade the speech waveform but does not provide any improvements to the waveform. The waveform compilation type speech synthesis system is better than the parameter compilation type speech synthesis system in terms of naturalness of synthesized speech but is still unsatisfactory in smoothness of the speech. Besides, the conventional waveform compilation type speech synthesis system accesses all labels in the database memory according to the phoneme string of the text to be speech-synthesized, and consequently, the access in the memory is inefficient and time-consuming.

SUMMARY OF THE INVENTION

A first object of the present invention is to make further improvements to the conventional waveform compilation type speech synthesis system to provide a method and apparatus which permit the synthesization of natural and smooth speech.

A second object of the present invention is to provide a waveform compilation type speech synthesis method and apparatus which permit efficient selective outputting of speech synthesis units in a short time.

According to a first aspect of the present invention, that one of phoneme waveforms in each of plural clusters, obtained by clustering of natural speech waveforms, which has a parameter nearest the centroid of their LPC parameters is stored as a representative phoneme waveform of each cluster in a waveform information memory. Representative phoneme waveforms of the same phoneme, which are most similar in context to each phoneme of a phoneme string of the speech to be synthesized, are selectively read out of the waveform information memory and sequentially concatenated to provide continued synthesized speech.

According to a second aspect of the present invention, representative phoneme waveforms and the parameters of the corresponding centroids are both stored as in the above first aspect. At the time of synthesizing speech, the centroid parameters are read out from the waveform information memory together with the representative phoneme waveforms, and the representative phoneme waveforms are corrected so that spectrum envelopes expressed by their parameters approach spectrum envelopes expressed by the centroid parameters, and the thus corrected representative phoneme waveforms are concatenated to form a synthesized speech waveform.

According to a third aspect of the present invention, the corrected representative phoneme waveforms may be prestored in the waveform information memory in the above second aspect.

According to a fourth aspect of the present invention, the waveform information memory also has stored therein, for each representative phoneme waveform, information about the speech fundamental frequency (the pitch frequency) of that phoneme waveform. At the time of synthesizing speech, those representative phoneme waveforms of the phonemes which have information about the fundamental frequency closest to that in prosodic information of the speech to be synthesized and have similar contexts are read out from the memory and concatenated.

Thus, in the present invention the representative phoneme waveforms that are used for speech synthesis are natural speech waveforms, and they are those preselected as phoneme waveforms nearest the centroids of the LPC parameters of phoneme waveforms in the respective phoneme waveform groups (clusters). Hence, the locus of the spectrum of the resulting synthesized speech, obtained for a sequence of phonemes of the speech to be synthesized, changes smoothly; therefore, the synthesized speech is natural and smooth. In addition, since the phoneme waveforms to be selected as speech synthesis units are representative phoneme waveforms selected from the respective clusters, the amount of data of these representative phoneme waveforms is far smaller than the amount of data of all speech waveforms stored in the database memory; accordingly, the phoneme waveforms as synthesis units can efficiently be selected in a short time.

Moreover, in accordance with the second aspect of the invention, since the representative phoneme waveforms are corrected so that envelopes of their spectrum characteristics approach those of the centroids of the respective phoneme waveform groups or clusters, it is possible to generate smoother and more natural synthesized speech by concatenating such corrected representative phoneme waveforms.

In this instance, if the spectrum characteristic is modified substantially, then the spectrum will be distorted to such an extent as to be perceivable. To avoid this, in the event that the total amount of modification is large, the spectrum characteristic of the respective representative phoneme waveform is modified step by step toward the target frequency spectrum characteristic to thereby prevent deterioration of the synthesized speech quality. Besides, if the spectrum is modified in synchronization with the fundamental frequency using the information about the fundamental frequency pre-added to the respective phoneme waveforms, it is possible to simplify remarkably the process and prevent the quality of synthesized speech from being degraded by an erroneous extraction of the pitch frequency, for instance.

DESCRIPTION OF THE PREFERRED EMBODIMENTS

Figure 1:
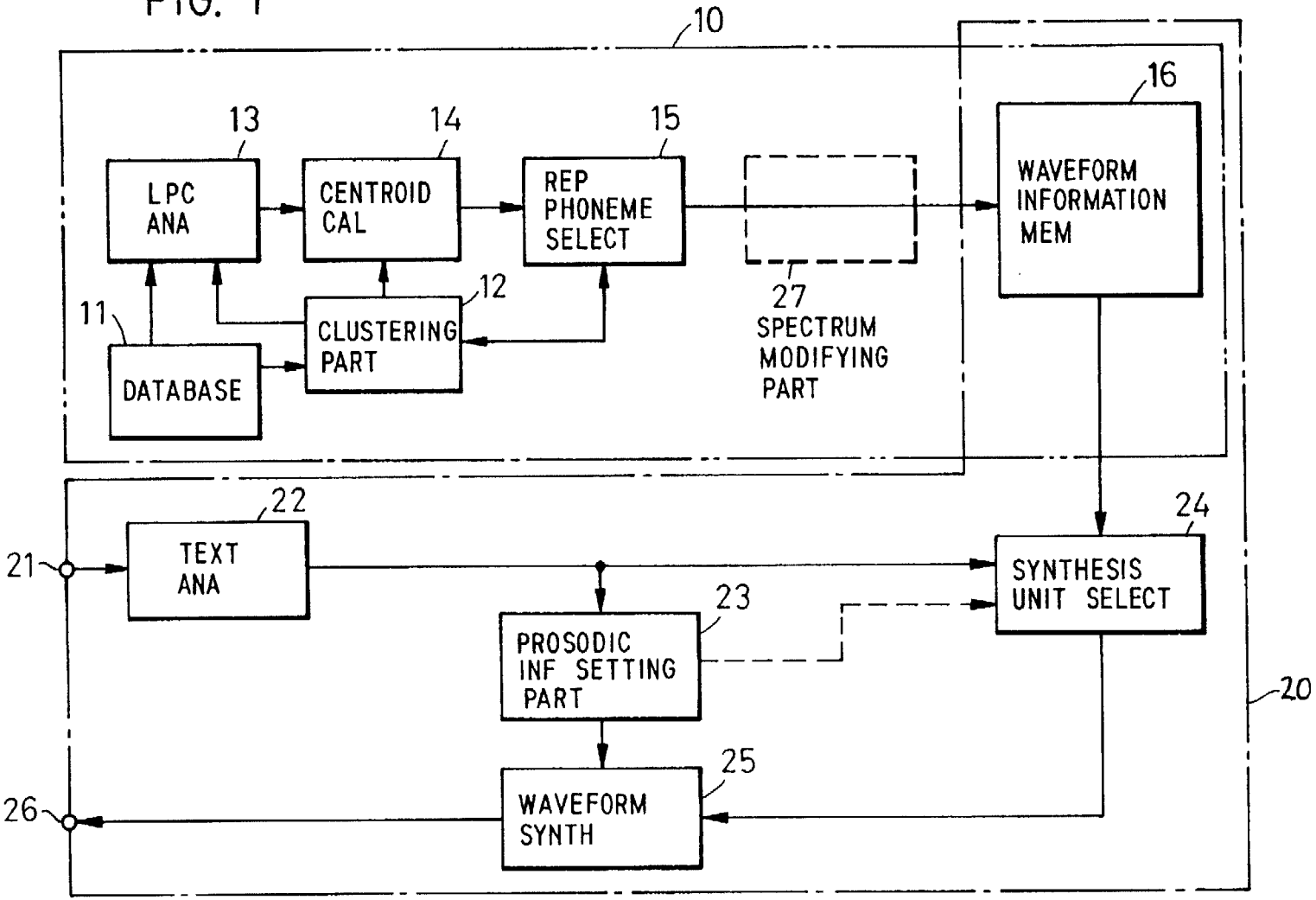
FIG. 1 is a block diagram illustrating a first embodiment of the waveform compilation type speech synthesizer according to the present invention.

In FIG. 1 there is illustrated in block form the waveform compilation type speech synthesizer according to a first embodiment of the present invention. The speech synthesizer of this embodiment is comprised of an analysis part 10 and a synthesis part 20. In a database 11 of the analysis part 10 there are stored natural speech waveforms obtained by normally uttering a sufficiently large number of sentences, phrases or words containing every combination of all phonemes usable for speech synthesis and one or more context phonemes preceding and/or succeeding each of the phonemes. The speech waveforms prestored in the database 11 are partitioned every phoneme segment and each phoneme waveform is provided by a clustering part 12 with an added label indicating the combination of the phoneme and its context and classified accordingly. The clustering can efficiently be implemented by a COC (Context Oriented Clustering) method set forth in the aforementioned literature by Nakajima et al, for example.

Figure 2:
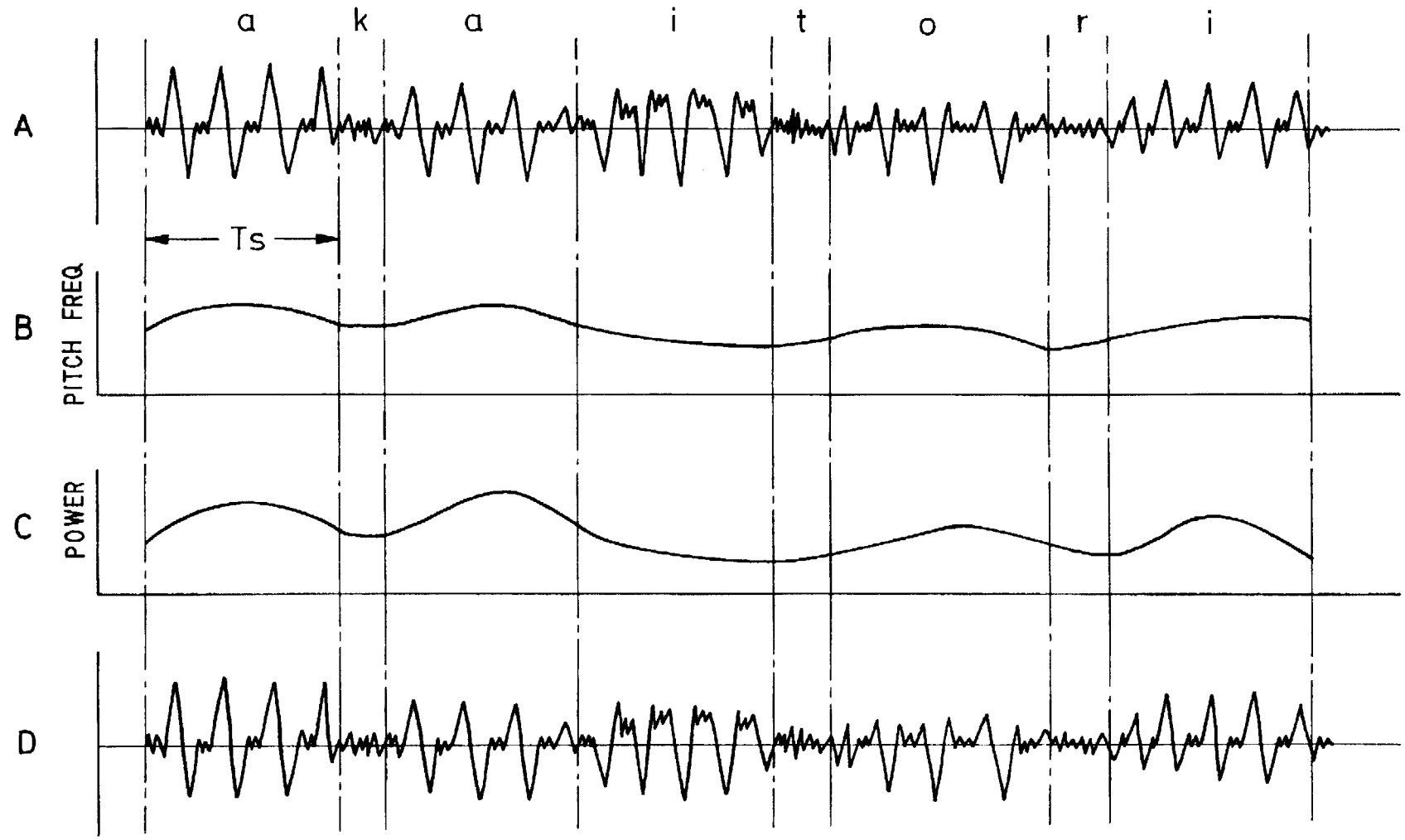
FIG. 2 is a waveform diagram showing examples of a speech waveform, a synthesis pitch contour, a power pattern and synthesized speech.

In FIG. 2—Row A there are shown a speech waveform corresponding to, for example, Japanese words "akai tori" (a red bird in English), stored in the database 11, and its phoneme partitions and labels. The first phoneme "a" is preceded by a space and succeeded by "k" and is labeled "ak." On the other hand, the third phoneme "a" is preceded by "k" and succeeded by "i" and is labeled "kai." Hence, these phonemes belong to different clusters. By such clustering, at least one phoneme waveform, in general, two or more phoneme waveforms are obtained in each cluster. It is also possible to provide clusters of phonemes each having two or more preceding and/or succeeding phonemes and, therefore, having different length of contexts.

An LPC analysis part 13 performs an LPC analysis of every phoneme waveform in each cluster with the width of an analysis window while shifting it by the frame to obtain predictive coefficient vectors (LPC parameters) representing the spectrum envelope. For example, the LPC analysis part 13 carries out the LPC analysis of each phoneme waveform with an analysis window of a 30 ms while shifting the window every 5 ms (one frame). Consequently, one set of LPC parameters (one parameter vector) are obtained for each frame. For instance, when the duration Ts of the third phoneme "a" in FIG. 2—Row A is 100 ms, 20 sets of LPC parameters (20 parameter vectors) are obtained. Assuming that one set of LPC parameters is composed of, for example, 12 elements (analysis orders), the LPC parameters of this phoneme waveform are expressed as a matrix of elements with 20 row and 12 columns. This will hereinafter be referred to as an LPC parameter matrix.

A centroid calculation part 14 calculates the centroid matrix of the LPC parameter matrixes of all phoneme waveforms in every cluster. The calculation method is disclosed in S. Roucos, "A segment vocoder at 150b/s," Proc. ICASSP, 17.1, 1987, for example. A representative phoneme selection part 15 selects from each cluster a phoneme waveform which provides the LPC parameter matrix nearest the centroid matrix calculated for each cluster and stores the selected phoneme waveform, as a representative of the cluster, in a waveform information memory 16 in correspondence to the label of the cluster.

Figure 3B:
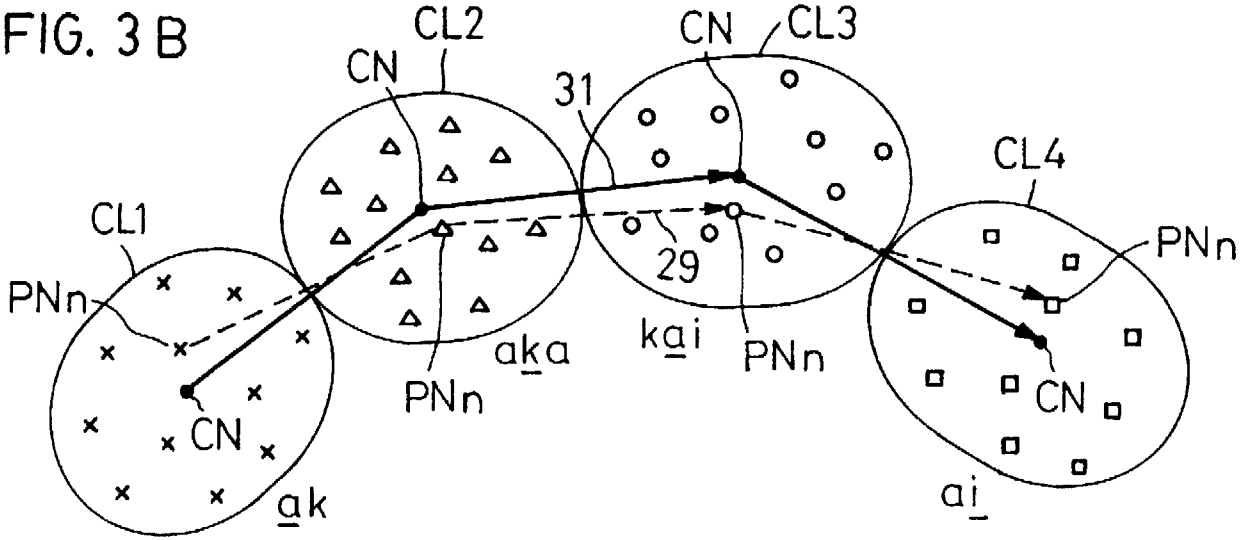
FIG. 3B is a conceptual diagram showing the locus of the spectrum characteristic of synthesized speech.
Figure 3A:
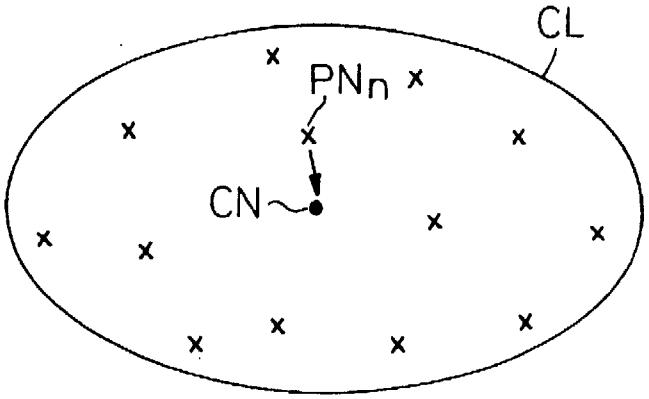
FIG. 3A is a conceptual diagram showing an example of the results of clustering.

FIG. 3A conceptually shows, by way of example, the distributions (indicated by crosses) of the LPC parameter matrixes of the same phoneme having the same contents "k" and "i" and hence belonging to the same cluster CL, together with the centroid CN (indicated by a dot) of the LPC parameter matrixes. The distributions of the parameter matrixes in each cluster represent a spectrum domain, and the LPC parameter matrix of the centroid CN in the cluster CL of the phoneme waveforms obtained by clustering represents the average spectrum envelope characteristic of this cluster. In practice, however, there exists no actual phoneme waveform which has the spectrum envelope characteristic at the point of the centroid CN. Then, in this embodiment, a phoneme waveform PNn whose parameter distance to the centroid CN is shortest in the cluster (i.e. closest to in terms of the spectrum envelope characteristic) is stored, as the phoneme waveform representative of the cluster CL, in the waveform information memory 16. Since a plurality of parameter vectors are obtained by performing the LPC analysis of each phoneme waveform every frame, the calculation of the centroid and calculations of the spectrum envelope and spectrum characteristic described below are all conducted by computing the matrixes each composed of the plurality of parameter vectors; however, since such a matrix computation itself is well-known in this technical field, the following description will not specifically indicate that the computation regarding the parameters is the matrix calculation.

The speech synthesis part 20 is made up of a text analysis part 22, a prosodic information setting part 23, a synthesis unit selection part 24 and a waveform synthesis part 25. The text analysis part 22 partitions an input text to a terminal 21 into phoneme segments and labels each segment as a combination with its context. At the same time, the text analysis part 22 detects a series of words from a phoneme string in the text by referring to a dictionary and determines the position and magnitude of an accent in each word and the intonation of the series of words in accordance with the dictionary and rules. The prosodic information setting part 23 sets the average pitch (according to a male voice or female voice) throughout the speech to be synthesized, pitch variation (the pitch contour) from the average pitch in accordance with the intonation of each word in the sentence, the duration of each phoneme following the utterance rate of the synthesized speech, the average power of the synthesized speech, power variations (the power pattern) from the average power in accordance with the accent in each word, and so forth. FIGS. 2—Row B and C show examples of the pitch pattern and power pattern set for the phoneme string of "akai tori" in the text. The pitch contour and power contour are determined so that the pitch and power for the respective phoneme segments smoothly continue between neighboring phonemes.

The synthesis unit selection part 24 reads out from the waveform information memory part 16 optimum synthesis units (the representative phoneme waveforms) for speech synthesis on the basis of the labels of the respective phonemes detected and labeled in the text analysis part 22, the synthesis units thus selected being provided to the waveform synthesis part 25. The selection of such a synthesis unit is performed, for example, by reading out of the memory 16 the synthesis unit of the same label as that provided from the text analysis part 22. For instance, the phonemes preceding and succeeding the third phoneme "a" in the text "akai tori" are "k" and "i", respectively; hence, the waveform of the phoneme "a" that has the same phonetic contexts as the third phoneme is selectively read out, as the synthesis unit of the same label as that of the third phoneme, from the memory 16. The label of the phoneme "a" in this example will hereinafter be indicated by "kai" and the labels of the other phonemes will be similarly indicated. However, the number of phonemes that constitute the context of each phoneme is not limited specifically to the two preceding and succeeding phonemes but it may sometimes be three, one, or zero.

The waveform synthesis part 25 imparts the phoneme duration, pitch contour and power contour, set by the prosodic information setting part 23, to the synthesis units (phoneme waveforms) fed from the synthesis unit selection part 24 and outputs the concatenated synthesis units to a terminal 26, as a synthesized speech waveform such as shown in FIG. 2—Row D. It is possible to change the pitch of the waveform while retaining its shape feature, by use of a method disclosed in B. Moulines, F. Charpentier, "Pitch-Synchronous Waveform Processing Techniques for Text-to-Speech Synthesis using Diphones," Speech Communication, Vol. 9, pp. 453–467, Dec. 1990, for instance.

In this way, speech is synthesized, for example, by concatenating the synthesis units of labels "ak", "aka", "kai"

and "ai" sequentially selected from the waveform information memory 16 in accordance with the phoneme string of the input text "akai". This is equivalent to joining, as indicated by broken lines in FIG. 3B, phoneme waveforms PNn having spectrum characteristics nearest the centroids CN in the spectrum spaces indicated by clusters CL1, CL2, CL3 and CL4 of the labels of the selected synthesis units. With this method, it is possible to synthesize speech smoother than in the case of concatenating phoneme waveforms selected randomly from respective clusters.

With the waveform compilation type speech synthesizer of the FIG. 1 embodiment, the synthesized speech quality is closer to natural speech or voice although the amount of information to be stored is larger than in the case of the aforementioned parameter compilation type speech analysis-synthesis system. In this embodiment, however, the phoneme waveform having parameters nearest the centroid of each cluster is used intact as the speech synthesis unit; hence, the synthesized speech is still unsatisfactory in terms of smoothness or fluency. To further enhance the smoothness of the synthesized speech, it is desirable to positively modify the spectrum characteristics of the speech synthesis units, as the feature quantity of the speech, and concatenate such speech synthesis units so that the spectrum characteristics of their waveforms become continuous and hence smooth. It is very hard, however, to modify the spectrum characteristic of a speech signal waveform. Various methods have been proposed to positively deform or correct the speech spectrum characteristic, but such processing is likely to cause deterioration of the signal quality and superimposition of noise. Of the conventional methods, a method which modifies the speech waveform in the frequency domain (Tohru Takagi et al, The Transactions of the Institute of Electronics, Information and Communication Engineers of Japan, SP87-111 (1988-01)) permits generation of high quality speech. This method, however, requires complex waveform processing for modifying the fundamental frequency and in phoneme duration control and has a defect that the speech quality deteriorates when the quantity of modification is large.

Figure 4A:
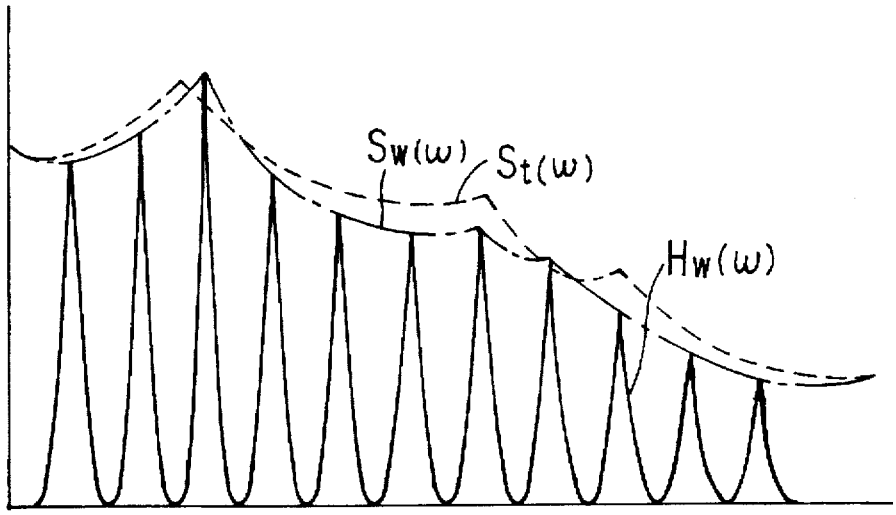
FIG. 4A is a diagram showing examples of the spectrum envelope of a centroid and the spectrum envelope and spectrum characteristic of a phoneme waveform before it is corrected.

To improve the synthesized speech in terms of smoothness or fluency, it is desired that phoneme waveforms which have parameters as close to the centroids as possible in respective clusters are used as synthesis unit waveforms. Of course, if the phoneme waveform having parameters on the centroid exists, then it will be sufficient to use it as the representative phoneme waveform (the synthesis unit waveform), but in practice, it is very unlikely that such a phoneme waveform exists. When the parameter of the actual phoneme waveform PNn and the parameter of the centroid CN do not match as shown in FIG. 3A, the spectrum envelope $S_r(\omega)$ expressed by the centroid parameters and the spectrum envelope $S_w(\omega)$ by the parameters nearest the centroid of the actual phoneme waveform do not match as shown in FIG. 4A. On the other hand, it is possible to obtain a fine structure of such a spectrum characteristic $H_w(\omega)$ as shown in FIG. 4A by spectrum analyzing the phoneme waveform nearest the centroid through the FFT (Fast Fourier Transform) procedure, for instance. The envelope of the spectrum characteristic $H_w(\omega)$ substantially matches the spectrum envelope $S_w(\omega)$ expressed by the LPC parameter for that phoneme waveform.

In view of the above, in the second embodiment, the phoneme waveform of the parameter nearest the centroid (which phoneme waveform will hereinafter be referred to as the nearest phoneme waveform) is frequency analyzed to obtain the spectrum characteristic $H_w(\omega)$, which is corrected so that its envelope matches the spectrum envelope $S_r(\omega)$ of the centroid, and the thus corrected spectrum characteristic $H_r(\omega)$ is subjected to the inverse Fourier transform processing to obtain a corrected phoneme waveform in the time domain, which is used as the representative phoneme. To perform this, the spectrum characteristic $H_w(\omega)$ of the nearest phoneme waveform is corrected at the rate of its spectrum envelope $S_w(\omega)$ to the spectrum envelope $S_r(\omega)$ of the centroid shown in FIG. 4A, in accordance with the following equation:

$$H_r(\omega)=H_w(\omega)*\{S_r(\omega)/S_w(\omega)\} \quad (1)$$

Figure 4B:
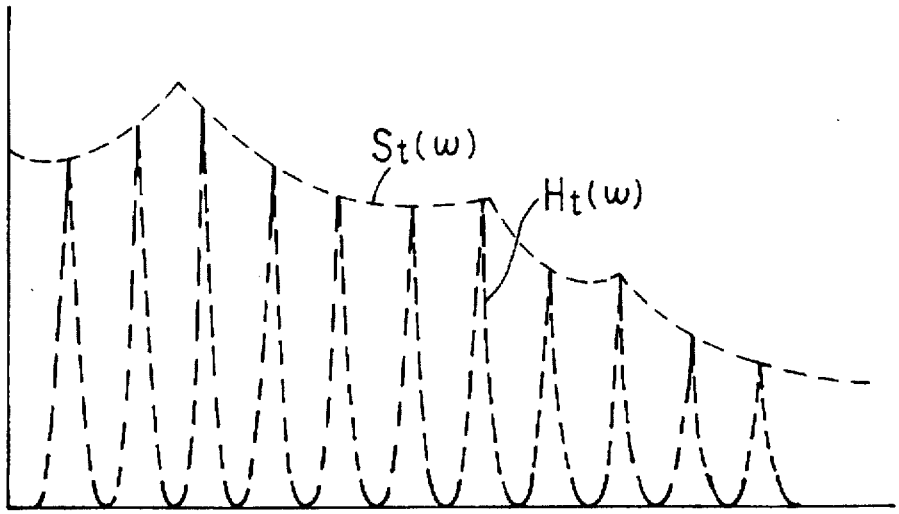
FIG. 4B is a diagram showing examples of the spectrum envelope of the centroid and its predicted spectrum characteristic.

By this, the corrected spectrum characteristic $H_r(\omega)$ is obtained which has a spectrum envelope substantially matching the centroid spectrum envelope $S_r(\omega)$ as shown in FIG. 4B. In the above equation the symbol * indicates a multiplication.

Next, the corrected spectrum characteristic $H_r(\omega)$ is subjected to inverse Fast Fourier Transform (IFFT) to obtain a waveform in the time domain. The phase information that is used in this inverse Fast Fourier Transform processing has been obtained by the Fourier Transform processing of the nearest phoneme waveform. The virtual phoneme waveform at the centroid thus obtained has a fine spectrum or spectral structure of the corrected spectrum characteristic of the nearest phoneme waveform, and hence is very close to the actual phoneme waveform. This phoneme waveform differs essentially from a waveform that is obtainable with a conventional speech synthesis system in which a synthesis filter, which simulates the vocal tract, is driven by pulses of a pitch frequency and noise through control of the centroid parameters.

Figure 5:
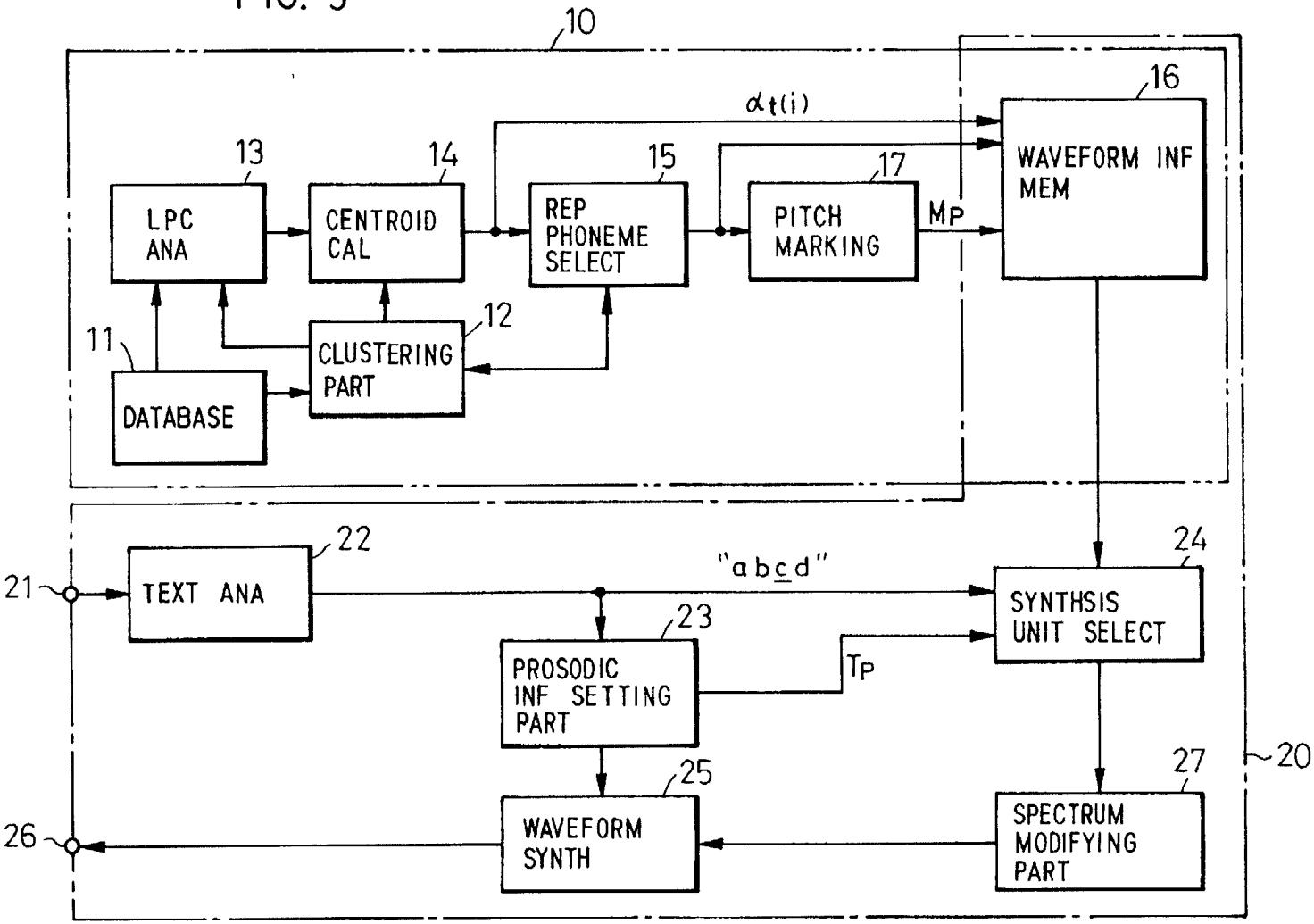
FIG. 5 is a block diagram illustrating a second embodiment of the present invention.

FIG. 5 illustrates the second embodiment which synthesizes speech on the principles described above. The parts corresponding to those in FIG. 1 are identified by the same reference numerals. As is the case with the FIG. 1 embodiment, the clustering part 12 clusters the phoneme string of the standard text, the LPC analysis part 13 LPC analyzes the phoneme segments in each cluster, and the centroid calculation part 14 calculates the centroid parameter {for example, what is called an α parameter $\alpha_r(i)$, i=1, . . . , p} of the LPC parameters of the respective phoneme waveforms. The speech unit selection part 15 stores in the waveform information memory 16 the phoneme waveform of the parameter $\{\alpha_w(i), i=1, \ldots, p\}$ nearest the centroid of each cluster in correspondence to its label. At the same time, in this embodiment, the calculated centroid parameter is also stored, as information representing the spectrum feature (the spectrum envelope), in the waveform information memory 16 in correspondence to the above-mentioned label.

Figure 6:
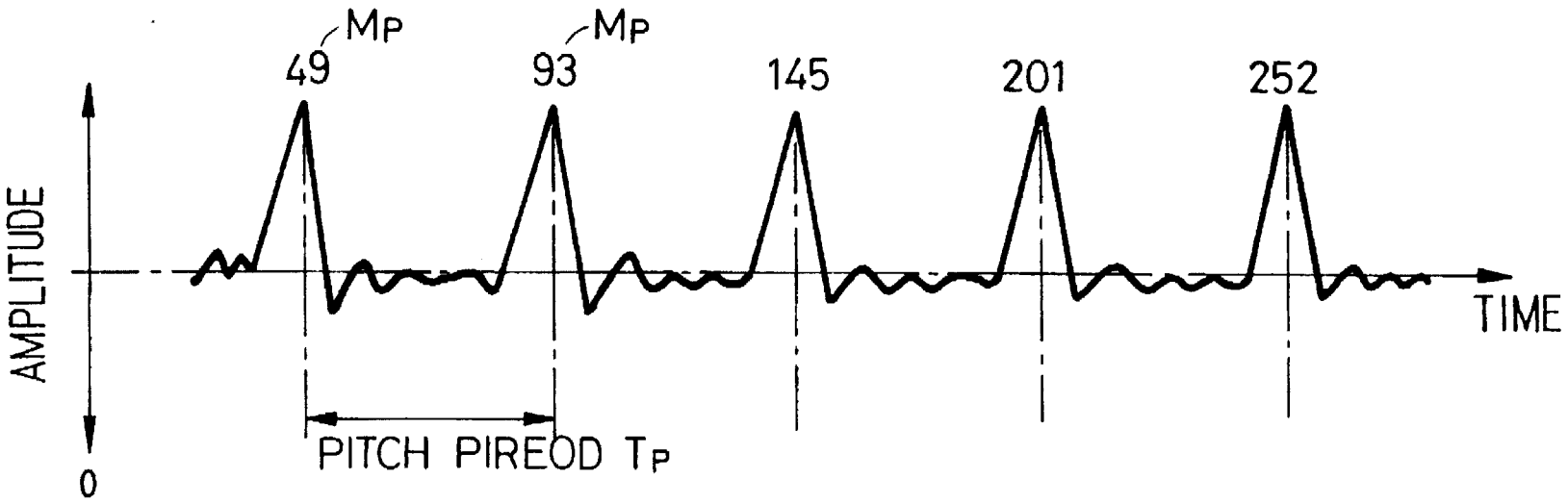
FIG. 6 is a waveform diagram for explaining pitch marks for phoneme waveforms.

In this embodiment, the entirety of each selected representative phoneme waveform is not corrected at one time unlike in the above, but instead the representative phoneme waveform is cut out or sliced and corrected every fixed period, for example, every frame or the integral multiple thereof, or in the case of the phoneme waveform of a voiced sound, the waveform is cut out every fundamental period (which cutout is called pitch synchronous cutout). This processing is performed iteratively over the entire length of the phoneme waveform. This embodiment shows, in particular, the case of cutting out the waveform every fundamental period i.e., pitch period. Furthermore, in this embodiment, of the representative phoneme waveforms selected by the speech unit selection part 15 from the speech database 11, the phoneme waveforms of voiced sounds, in particular, are provided to a pitch marking part 17, wherein the pitch period is detected and a mark indicating the reference position of the speech pitch period—what is called a pitch mark—is added to the waveform information. In the case of such a speech waveform as shown in FIG. 6, the time interval between adjoining large peaks is the pitch period Tp and a mark (a sample number, for example) Mp, which indicates the temporal position of each large peak of the speech waveform, is the pitch period mark (the pitch mark). In the waveform information memory 16 each representative phoneme waveform (the speech synthesis unit) is stored in correspondence to its label, besides the LPC parameter $\alpha_r(i)$ of the centroid of the corresponding cluster and the pitch mark information Mp are stored as mentioned previously.

In the speech synthesis part 20, as is the case with the FIG. 1 embodiment, the text fed to the input terminal 21 is provided first to the text analysis part 22, which partitions it to phoneme strings, labels them, detects words from the respective phoneme string by referring to a dictionary and then determines the accent and intonation of the phoneme string according to the rules laid down. The prosodic information setting part 23 also set the desired pitch pattern, phoneme segment duration, power pattern, etc. of the speech to be synthesized, as in the FIG. 1 embodiment. In the synthesis unit selection part 24, the synthesis unit of the same label (and consequently, of the same context) as the label of each phoneme in the text may be selected from the waveform information memory 16 as in the FIG. 1 embodiment; but it is also possible to select a synthesis unit most similar to the phoneme in the text, taking into account the pitch period of the phoneme as well as the context phoneme, as described below.

To perform this, the clustering part 12 of the analysis part 10 carries out clustering in the following manner. Of the clusters classified according to the combination of each phoneme and at least one or more adjoining phonemes in the natural speech waveform data as described previously in respect of FIG. 1, the clusters composed of phoneme waveforms of voiced sounds are each split into a plurality of groups according to the length of the pitch period Tp and these subdivided groups are labeled as minimum clusters. In the LPC analysis part 13 the LPC parameters of the phoneme waveforms in each cluster are obtained and in the centroid calculation part 14 the centroid of those parameters is calculated. In the representative phoneme waveform selection part 15 the phoneme waveform, which has the parameter nearest the centroid in each cluster, is selected as the representative phoneme waveform and it is stored in the waveform information memory 16 in correspondence to the label of the cluster, together with the pitch information Mp (or pitch period Tp) detected in the pitch marking part. The parameter of the centroid is also stored corresponding to the label.

Now, let the evaluation function E for selecting the representative phoneme waveform (the synthesis speech unit) most similar to the phoneme in the text be expressed as follows:

$$E=\beta DC+(1-\beta)Dp \tag{2}$$

$$Dc=\Sigma k_h/\Sigma \mathrm{Max}\{k_h\} \tag{3}$$

$$Dp=|Tp-Tp'|/\Sigma|\Delta Tp| \tag{4}$$

where $\beta$ is a predetermined constant larger than 0 but smaller than 1, Dc is the mismatching degree in phoneme context and Dp is the pitch mismatching degree. Their weighted sum E indicates the total mismatching degree against the representative phoneme waveform of the selected label.

For instance, assume that the label of a phoneme "c" in the input text fed to the terminal 21 is indicated generally by a label "abcd;Tp" using the pitch period Tp with which the phoneme is to be generated and the adjoining phonemes. From the waveform information memory 16 are selectively read out by the synthesis unit selection part 24 the representative phoneme waveforms of all labels of the phoneme "c" indicated generally by a label "b'cd';Tp'". For match and mismatch between the context phonemes at the corresponding positions of these labels, values such as given below are determined.

$k_1=0$ for a'=a, otherwise $k_1=0.5$ $k_2=0$ for b'=b, otherwise $k_2=1.0$ $k_3=0$ for d'=d, otherwise $k_3=1.0$ In this instance, Equation (3) becomes as follows:

$$Dc=\Sigma k_h/(0.5+1.0+1.0)=\Sigma k_h/2.5 \ (h=1,2,3)$$

On the other hand, $\Sigma|\Delta Tp|$ in Equation (4) is the sum total of the absolute values $|\Delta Tp|$ of differences between the pitch Tp with which the text phoneme "c" is to be generated and the pitch periods Tp' of the representative phoneme waveforms of all the phonemes "c" indicated by the label "a'b'cd'; Tp'", and $|Tp-Tp'|$ is the absolute value of the difference between the pitch period Tp of the phoneme "c" in the text and the pitch period Tp of the selected representative phoneme waveforms. The representative phoneme waveform which minimizes the evaluation function E is chosen as the phoneme waveform most similar to the phoneme "c" in the input text. As the evaluation function for defining the similarity degree, various other forms can easily be defined; the above-said function is just one example.

Each representative phoneme waveform selected by the synthesis unit selection part 24 is provided to a spectrum characteristic modification part 27, wherein it is modified so that the spectrum envelope $S_g(\omega)$, indicated by the LPC parameter $\alpha_g(i)$ of the waveform segment cut out of the representative phoneme waveform, may approach the spectrum envelope $S_r(\omega)$ indicated by the LPC parameter $\alpha_r(i)$ of the corresponding centroid. The thus modified speech waveform information is fed to the waveform synthesis part 25.

Incidentally, the LPC parameter $\alpha(i)$, where i=1, . . . , p, represents the spectrum envelope $S(\omega)$ of the waveform as expressed by the following equation:

$$S(\omega)=\frac{\sigma^2}{2\pi|1+\Sigma\alpha(i)z^{-i}|^2} \tag{5}$$

Once the parameter $\alpha(i)$ is given, the spectrum envelope is determined unequivocally. In the above, $\Sigma$ is a summation calculation for i=1 to p, $z=e^{j\omega t}$ and $\alpha^2$ is the power. That is, to correct the phoneme waveform so that the spectrum envelope $S_w(\omega)$ of the nearest phoneme waveform matches the centroid spectrum envelope $S_r(\omega)$, as shown in FIGS. 4A and 4B, is to correct the parameter of the nearest phoneme waveform as well.

When the interparameter distance (i.e. the difference) between the centroid and the nearest phoneme waveform is 1 dB or less, even if the spectrum characteristic is corrected according to Equation (1), the resulting change is not perceivable auditorily (see, for example, K. Itoh et al, "Objective Quality Measures for Speech Waveform Coding System", Review of the E.C.L., Vol. 32, No. 2, pp 220–228, 1984). Hence, the difference between the LPC parameter of the above-mentioned pitch-synchronously cut-out waveform segment and the LPC parameter of the centroid can be corrected in one stage, but when the interparameter distance is larger, such a one-stage correction of the difference is not preferable because the variation (or the spectrum distortion) is perceived. The reason for the occurrence of this spectrum distortion is that the spectrum envelope indicated by the fine structure $H(\omega)$ of the spectrum characteristic obtained usually by Fourier transform processing of the waveform does not precisely match the spectrum envelope $S(\omega)$ represented by the parameter obtained by the LPC analysis of the same waveform. To avoid this, it is preferable that upon each each correction of the spectrum characteristic with a predetermined step size that keeps the interparameter difference below 1 dB, the speech waveform is reproduced from the corrected spectrum characteristic to correct the difference in steps.

Figure 7:
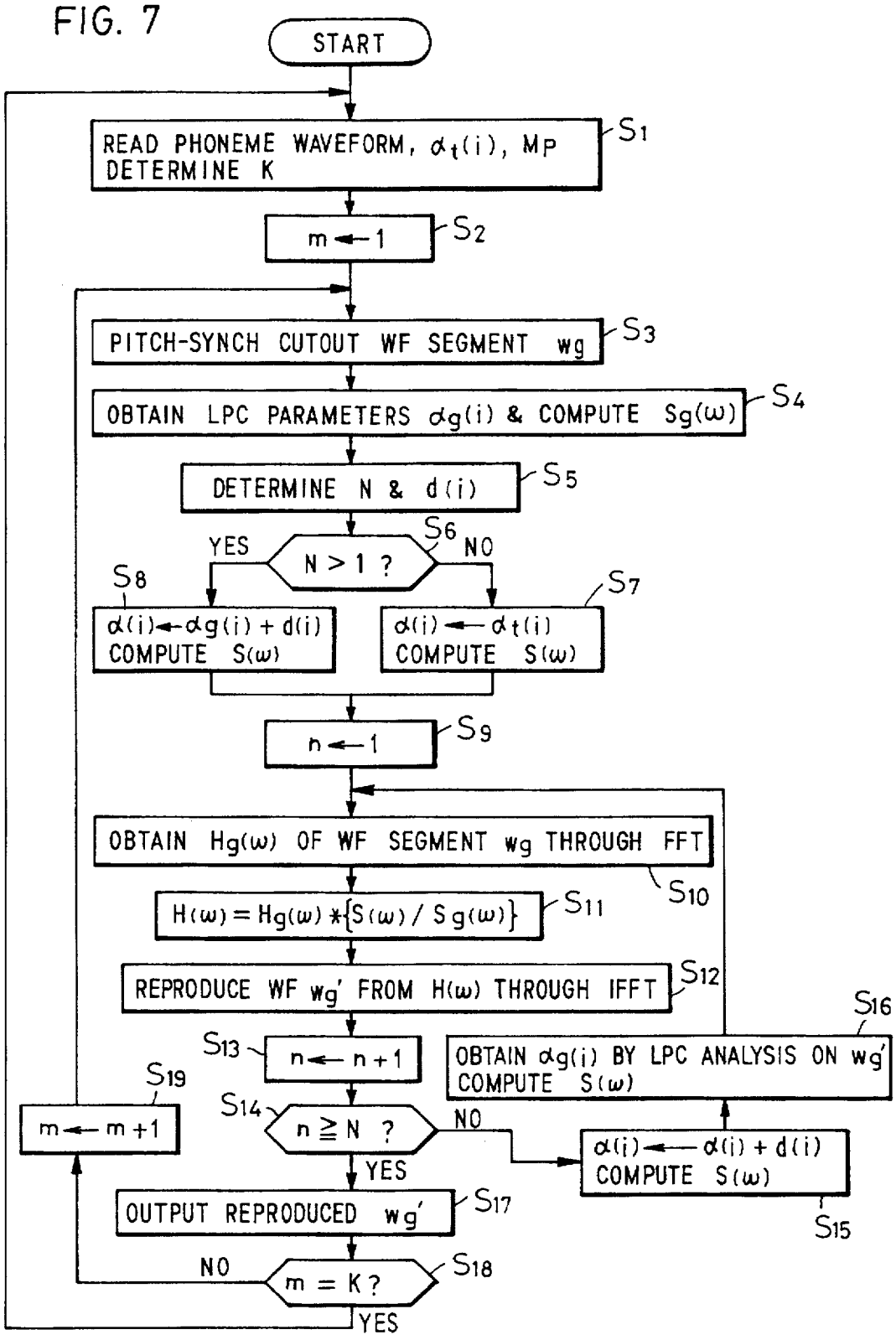
FIG. 7 is a flowchart showing an example of a spectrum characteristic modifying process.

In FIG. 7 there is outlined the procedure of the spectrum characteristic modifying part 27. The representative phoneme waveform marked with the pitch mark of each label, selected by the synthesis unit selection part 24, and the LPC parameter $\alpha_r(i)$ of the centroid of the label are read out of the waveform information memory 16 and the number K of the pitch marks Mp in the representative phoneme waveform are counted (step $S_1$). The number K of pitch marks indicates the number of waveform segments $w_g$ that are obtained by cutting the phoneme waveform every pitch period in the subsequent processing. In step $S_2$ the initial value of the processing number m is set to 1 and in step $S_3$ the waveform segment $w_g$ of the first pitch period length is cut out of the phoneme waveform. The segment may be cut out by multiplying the phoneme waveform by such a window function W(j) as given below by Equation (6).

$$W(j)=0.5-0.5\cos(2\pi j/L)\ (\text{where } j=0, \ldots, L) \tag{6}$$

Letting the pitch period of the speech to be synthesized be represented by Tp, the sample number L is given by $L \cong 2Tp$. This window function increases the precision of the frequency analysis and reduces the waveform distortion at the time of superimposing the waveform of the pitch period in the waveform synthesizing part 25. The waveform segment $w_g$ cut out in the step $S_3$ is LPC analyzed in step $S_4$ to obtain the parameter $\{\alpha_g(i), i=1, \ldots, p\}$ and at the same time, the spectrum envelope $S_g(\omega)$ expressed by the LPC parameter $\alpha_g(i)$ is calculated from Equation (5). Then, in step $S_5$ the amount of variation in the parameter, d(i), each time it is modified and the number of times, N, the parameter is modified are calculated by the following equations using a predetermined threshold value Th which defines an allowable spectrum distortion not perceivable auditorily, the parameter $\alpha_r(i)$ of the read-out centroid and the parameter $\alpha_g(i)$ of the segment $w_g$ obtained in step $S_4$.

$$N=[\Sigma\{\alpha_r(i)-\alpha_g(i)\}^2/Th] \tag{7}$$

$$d(i)=\{\alpha_r(i)-\alpha_g(i)\}/N(i=1, \ldots, p) \tag{8}$$

where $\Sigma$ represents a summation calculation for i=1 to p and p represents the prediction order. The threshold value Th is a value that depends on the total characteristic, and when it is too large, the distortion increases. In step $S_6$ it is determined whether N is 1 or larger. If N=1, then the flow proceeds to step $S_7$, wherein the corrected spectrum envelope $S(\omega)$ is computed by the following Equation (9) similar to Equation (5) with the correction parameter $\alpha(i)$ set to $\alpha(i)=\alpha_r(i)$. When N>1, the flow proceeds to step $S_8$, wherein the corrected spectrum envelope is computed by Equation (9) with the parameter $\alpha(i)$ set to $\alpha(i)=\alpha_g(i)+d(i)$.

$$S(\omega)=\frac{\sigma^2}{2\pi|1+\Sigma\alpha(i)z^{-i}|^2} \tag{9}$$

Next, the parameter update number n is initialized to 1 (step $S_9$), after which the waveform segment cut out as referred to previously is frequency analyzed by Fast Fourier Transform (FFT) processing to obtain the spectrum characteristic $H_g(\omega)$ (step $S_{10}$). In a spectrum characteristic modification processing step $S_{11}$, the above-mentioned spectrum characteristic $H_g(\omega)$ of the cut-out waveform segment $w_g$ obtained in step $S_{10}$ is corrected by the following Equation (10) similar to Equation (1) on the basis of the spectrum envelope $S_g(\omega)$ of the waveform segment $w_g$ obtained in step $S_4$ and the corrected spectrum envelope $S(\omega)$ computed in step $S_7$ or $S_8$. In this way, the corrected spectrum characteristic $H(\omega)$ is obtained.

$$H(\omega)=H_g(\omega) * \{S(\omega)/S_g(\omega)\} \tag{10}$$

Here, the frequency spectra indicated by $H(\omega)$ and $H_g(\omega)$ represent their absolute values and the phase information uses the value of the original signal.

In step $S_{12}$ the corrected spectrum characteristic $H(\omega)$ is subjected to Inverse Fast Fourier Transform (IFFT) processing, thereby reproducing the waveform in the time domain. In step $S_{13}$ the number of times that the spectrum is corrected in step $S_{11}$ is counted and the count value is determined in step $S_{14}$. In step $S_{15}$ the correction parameter $\alpha(i)$ is modified to $\alpha(i)+d(i)$ and in step $S_{16}$ the spectrum characteristic is corrected accordingly. This processing is repeated until the count value n becomes equal to N in step $S_{14}$. That is, the value n is incremented in step $S_{13}$ and in step $S_{14}$ a check is made to see if n is greater than N. If not, the flow proceeds to step $S_{15}$, wherein d(i) is added to the parameter $\alpha(i)$ to update it and the corresponding corrected spectrum envelope $S(\omega)$ is computed from Equation (9). Next, the flow goes back to step $S_{10}$, wherein the waveform reproduced in step $S_{12}$ is subjected to Fourier Transform processing to obtain the frequency spectrum characteristic $H_g(\omega)$. These new $H_g(\omega)$, $S_g(\omega)$ and $S(\omega)$ are used to perform the spectrum modification processing by Equation (10) in step $S_{11}$. When the value n exceeds N in step $S_{14}$, the latest reproduced waveform obtained in step $S_{12}$ is output in step $S_{17}$.

In step $S_{18}$ a check is made to see if processing of all waveform segments Wg has finished, and if not, then the flow proceeds to step $S_{19}$ to increment the cut-out number m and goes back to step $S_3$, wherein the next waveform segment Wg is cut out with a value twice the pitch period, after which the same processing is carried out again. When it is determined in step $S_{18}$ that the processing of all segments has been completed, the flow returns to step $S_1$ to read out the speech synthesis unit, centroid parameter $\alpha_r(i)$ and pitch mark information Mp corresponding to the next phoneme of the input text, performing the same processing as described above.

Figure 8:
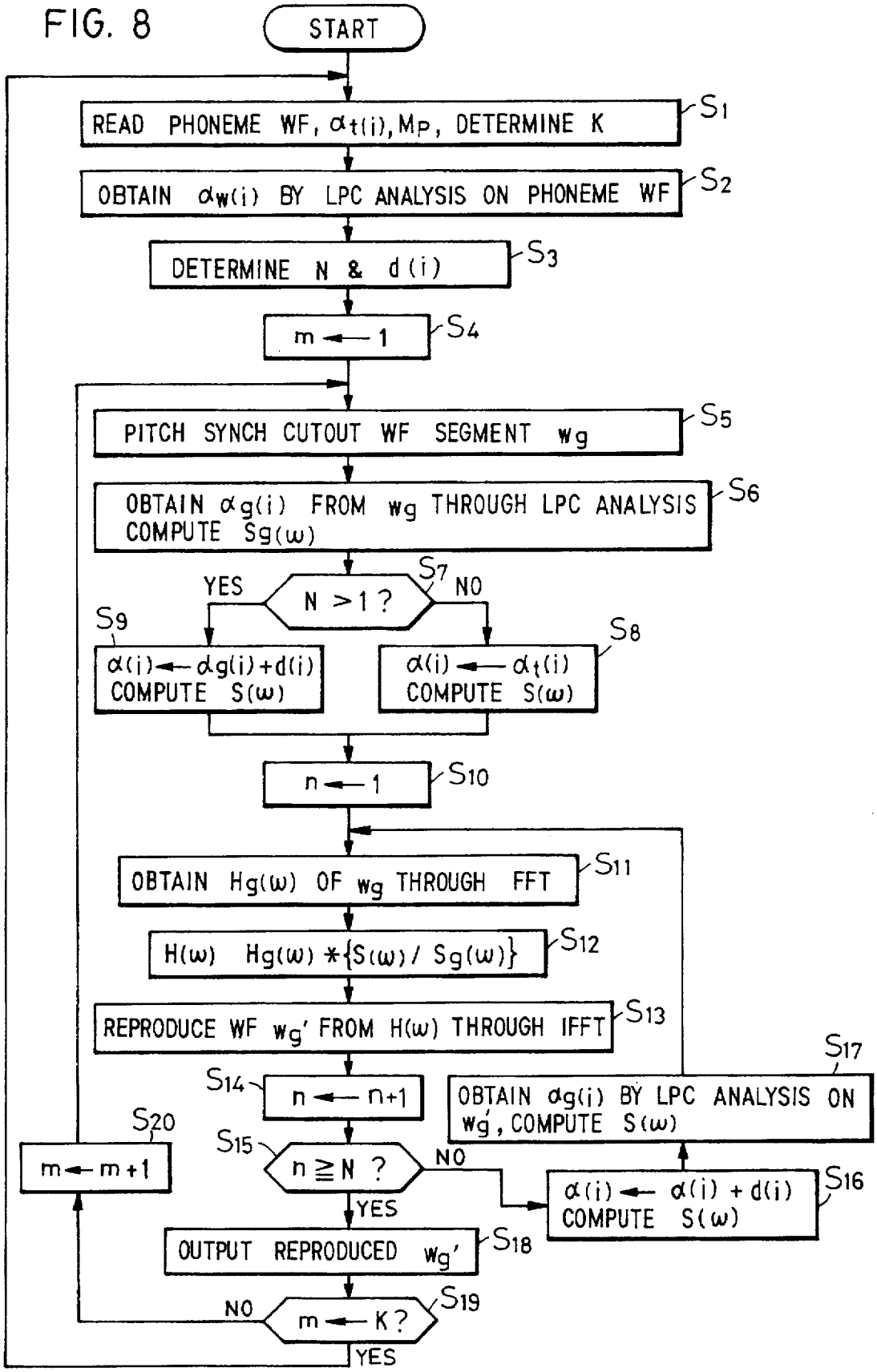
FIG. 8 is a flowchart showing another example of the spectrum characteristic modifying process.

In the spectrum characteristic modification processing depicted in FIG. 7 the number N of modifications of the spectrum characteristic and the modification width d(i) are determined by Equations (7) and (8) for each waveform segment cut out from the selected phoneme waveform, but it is also possible, with a view to reducing the quantity of computation involved, to employ a method as shown in FIG. 8 in which the number of times N and the modification width d(i) are computed from the following equations for the selected phoneme waveform and the computed values are used in common to all the segments cut out from the selected phoneme waveform to thereby modify the spectrum characteristic.

$$N=[\Sigma\{\alpha_r(i)-\alpha_w(i)\}^2/Th] \quad (7')$$

$$d(i)=\{\alpha_r(i)-\alpha_w(i)\}/N(i=1, \ldots, p) \quad (8')$$

In this case, the phoneme waveform and the LPC parameter $\alpha_r(i)$ of the centroid are read out from the waveform information memory 16 in step $S_1$, then in step $S_2$ the thus read out phoneme waveform is LPC analyzed to obtain the parameter $\alpha_w(i)$, and in step $S_3$ the number of times N and the modification width d(i) are determined by Equations (7') and (8'). The subsequent steps $S_4$ through $S_{20}$ are identical in the contents of processing with steps $S_2$, $S_3$, $S_4$ and $S_6$ through $S_{19}$ in FIG. 17, and hence no description will be given of them.

In the case of processing of FIG. 8 the parameter $\alpha_w(i)$ is obtained by LPC analyzing the phoneme waveform in step $S_2$, but this step $S_2$ could be left out when employing a construction in which, of the parameters of the phoneme waveforms obtained in the LPC analysis part 13 for computing the centroid in the analysis part 10 of FIG. 5, the parameter $\alpha_w(i)$ of the representative phoneme waveform selected in the representative phoneme selection part 15, obtained in the LPC analysis part 13, is prestored in the waveform information memory 16 in correspondence to that representative phoneme waveform and is subsequently read out in step $S_1$ together with the phoneme waveform in the speech synthesis processing. Incidentally, the quantity of computations involved in the course of speech synthesis could be reduced by precomputing the quantity d(i) of spectrum modification and the number of repetitions N at the stage of the analysis of speech data stored in the database 11 and prestoring them in the waveform information memory 16, but it is dependent on the capacity of the memory and the throughput of the entire system whether to use such a construction.

In the above, each speech waveform selected by the representative phoneme selection part 15 is stored intact in the waveform information memory 16, but the throughput in the synthesizing part 20 could be decreased by using a construction in which the selected phoneme waveform segment is subjected to the spectrum modification processing shown in FIGS. 7 or 8 by the spectrum characteristic modifying part 27 indicated by the broken line in FIG. 1 to thereby convert to a speech waveform having the corresponding reference spectrum, that is, the representative phoneme waveform segment is prestored in the waveform information memory 16 as a speech waveform having the reference spectrum at the centroid in each cluster.

Moreover, by prestoring the pitch mark information Mp as well in the waveform information memory 16 and by cutting out the speech waveform with the pitch period (or frame period) in the spectrum characteristic modifying part 27 as described previously, the spectrum characteristic can be modified more precisely; however, the synthesized speech quality could be further enhanced by selecting reading out of the prosodic information setting circuit 23 waveform information close to the desired pitch period of the synthesized speech. That is, even if the pieces of speech unit waveform information have the same phonetic context, some representative ones of them which greatly differ in pitch period are prestored and subsequently the waveform information which is close to the pitch period of the synthesized speech is selected.

In the above embodiments the phoneme waveform segment is subjected to LPC analysis, but there are known various types of LPC analysis using the above-mentioned so-called α parameter, the LSP parameter, the PARCOR parameter, the LPC cepstrum parameter, and so forth, and these parameters can be exchanged. Accordingly, any of these parameters is capable of representing the spectrum envelope and hence could be used in the present invention. For example, the relationship between the LPC cepstrum parameter {C(i), i=1, . . . , p} and the α parameter is given by the following equation:

$$C(1) = -\alpha(1) \quad (11)$$

$$C(n) = -\alpha(n) - \sum_{m=1}^{n-1}\left(1-\frac{m}{n}\right)\alpha(m)C(n-m)$$

for $1 < n \leqq p$ $$C(n) = -\sum_{m=1}^{p}\left(1-\frac{m}{n}\right)\alpha(m)C(n-m)$$

for $p < n$

Hence, the spectrum envelope S(ω) can be obtained from Equation (5). It is also possible to use a Mel-logarithmic cepstrum which takes the auditory characteristic into account.

As described above, according to the present invention, since the representative phoneme waveform segment, which has the parameter nearest the centroid of the respective cluster, is used as the speech synthesis unit, smooth speech can be synthesized by relatively simple processing. In particular, by modifying the spectrum characteristic of the representative phoneme waveform segment to approach the spectrum envelope of the centroid, more smooth synthesized speech close to the natural voice could be obtained. In addition, since the representative phoneme waveform segments selected from the clustered phoneme waveforms are stored in the waveform information memory and waveforms as the speech synthesis units are selected from the representative phoneme waveform segments stored in the memory, the required speech synthesis units can efficiently be accessed in a short time.

It will be apparent that many modifications and variations may be effected without departing from the scope of the novel concepts of the present invention.

What is claimed is:

1. A waveform compilation type speech synthesizer comprising:

waveform pre-classifying means for pre-classifying each of a plurality of phoneme waveforms in natural speech waveforms into a corresponding one of a plurality of clusters according to a phoneme in combination with one or more neighboring context phonemes;

calculating means for calculating a centroid for each of the clusters according to parameters representing spectra of the phoneme waveforms in the cluster;

correcting means for correcting one of the phoneme waveforms in each of said clusters having a parameter nearest a corresponding one of the centroids so that an envelope of spectrum characteristic of said one phoneme waveform approaches a spectrum envelope represented by a parameter of said centroid;

waveform storing means for storing each of the corrected phoneme waveforms as a representative phoneme waveform of said each cluster; and synthesizing means comprising sequential reading means for sequentially reading desired ones of said representative phoneme waveforms from said waveform storing means and concatenating means for concatenating the representative phoneme waveforms read out from said waveform storing means for output as a synthesized speech waveform.

2. A waveform compilation type speech synthesizer comprising:

waveform pre-classifying means for pre-classifying each of a plurality of phoneme waveforms in natural speech waveforms into a corresponding one of a plurality of clusters according to a phoneme in combination with one or more neighboring context phonemes;

calculating means for calculating a centroid for each of the clusters according to parameters representing spectra of the phoneme waveforms in the cluster;

waveform storing means for storing, as a representative phoneme waveform, one of said phoneme waveforms in each of said clusters representing a parameter nearest the centroid; and synthesizing means comprising sequential reading means for sequentially reading desired ones of said representative phoneme waveforms from said waveform storing means and concatenating means for concatenating the representative phoneme waveforms read out from said waveform storing means for output as a synthesized speech waveform.

3. The waveform synthesizer of claim 2 wherein said waveform storing means includes centroid storing means for storing said parameter of said centroid in correspondence to each of said representative phoneme waveforms, said synthesizing means further including spectrum modifying means for modifying each of said representative phoneme waveforms read out of said waveform storing means so that an envelope of a spectrum characteristic of said each representative phoneme waveform approaches a spectrum envelope represented by the parameter of said centroid read out correspondingly, and said concatenating means concatenates said modified representative phoneme waveforms for output as said synthesized speech waveform.

4. The speech synthesizer of claim 2, 1 or 3 wherein said sequential reading means further comprises means for selecting the stored representative phoneme waveforms that are most similar in context to corresponding phonemes in an input text.

5. The speech synthesizer of claim 4 wherein said synthesizing means further comprises text analyzing means for analyzing said input text and outputting a phoneme string, and prosodic information setting means for setting a desired pitch of the speech to be synthesized with respect to said phoneme string.

6. The speech synthesizer of claim 5 wherein a plurality of ranges of predetermined pitches of said phoneme waveforms are included as elements for clustering said phoneme waveforms, said synthesizing means including evaluating means for evaluating each phoneme in a phoneme string of said text in a degree of similarity to each of said representative phoneme waveforms in said waveform storing means by a predetermined evaluation function on the basis of a phoneme adjoining said each phoneme and the desired pitch set by said prosodic information setting means and obtaining an evaluation value, said selecting means selecting said most similar representative phoneme waveform on the basis of said evaluation value.

7. The speech synthesizer of claim 2 wherein said pre-classifying means comprises:

clustering means for pre-classifying respective phoneme waveforms in a natural speech waveform into clusters according to phonemes in combination with neighboring context phonemes; and LPC analyzing means for LPC analyzing each of said phoneme waveforms in said clusters to obtain a parameter representing a spectrum envelope of said each of the phoneme waveforms;

said waveform storing means further comprising:

representative phoneme waveform selecting means for selecting, as said representative phoneme waveform, said one of said phoneme waveforms having said parameter nearest said centroid of each of said clusters; and waveform information storing means for storing said representative phoneme waveforms of said clusters.

8. The speech synthesizer of claim 2 or 7, wherein said synthesizing means comprises:

text analyzing means for analyzing said input text to obtain a phoneme string and prosodic information;

said sequential reading means sequentially reading out, as synthetic unit waveforms from said waveform storing means, representative phoneme waveforms nearest respective phonemes of said phoneme string obtained by said text analyzing means; and said concatenating means sequentially concatenating said read-out synthesis unit waveforms, imparting a prosodic property to said concatenated synthesis unit waveforms and outputting them as a continuous synthesized speech waveform.

9. The speech synthesizer of claim 8 wherein said waveform storing means has stored therein the parameters of said centroids in correspondence to said representative phoneme waveforms, respectively, said synthesizing means including spectrum modifying means for modifying each of said representative phoneme waveforms read out of said waveform storing means so that an envelope of a spectrum characteristic of said each representative phoneme waveform approaches a spectrum envelope represented by the parameter of said centroid read out correspondingly, and said concatenating means concatenates said modified representative phoneme waveforms for output as said synthesized speech waveform.

10. The speech synthesizer of claim 9 wherein said waveform pre-classifying means includes means for detecting pitch positions of said representative phoneme waveforms and for prestoring the detected pitch positions as pitch information in correspondence to said representative phoneme waveforms, respectively; said sequential reading means reading out of said waveform storing means said representative phoneme waveforms together with the parameters of said centroids and said pitch information corresponding to said read-out representative phoneme waveforms; and said spectrum modifying means including means for cutting each of said representative phoneme waveforms every integer multiple of a pitch period on the basis of said read-out pitch information and, for each cut-out waveform, modifying its spectrum characteristics so that it approaches the spectrum envelope represented by the parameter of said centroid.

11. A waveform compilation type speech synthesizing method comprising the steps of:

A. pre-classifying each of a plurality of phoneme waveforms in an actual speech waveform into a corresponding one of clusters according to a phoneme in combination with one or more neighboring context phonemes;

B. calculating a parameter of a centroid of parameters representing spectra of respective phoneme waveforms in each cluster and selecting, as a representative phoneme waveform, one of said phoneme waveforms which has a parameter nearest said parameter of said centroid;

C. correcting each of said representative phoneme waveforms so that an envelope of its spectrum characteristic approaches a spectrum envelope represented by the parameter of said centroid;

D. storing said corrected representative phoneme waveforms in waveform information storing means;

E. selectively reading out of said waveform information storing means the representative phoneme waveforms of the same phoneme in a phoneme string of speech to be synthesized and most similar to the respective phonemes; and F. sequentially concatenating said read-out representative phoneme waveforms for output as a synthesized speech waveform.

12. A waveform compilation type speech synthesizing method comprising the steps of:

A. pre-classifying each of a plurality of phoneme waveforms in a natural speech waveform into a corresponding one of a plurality of clusters according to a phoneme in combination with one or more neighboring context phonemes;

B. calculating a parameter of a centroid of parameters representing spectra of respective phoneme waveforms in each cluster and selecting, as a representative phoneme waveform, one of said phoneme waveforms which has a parameter nearest said parameter of said centroid;

C. storing said selected representative phoneme waveform in waveform information storing means;

D. selectively reading out of said waveform information storing means the representative phoneme waveforms of the same phoneme in a phoneme string of speech to be synthesized and most similar to the respective phonemes; and E. sequentially concatenating said read-out representative phoneme waveforms for output as a synthesized speech waveform.

13. The method of claim 12, wherein said step C includes storing in said waveform information storing means the parameters of said centroids in correspondence to said representative phoneme waveforms, respectively; said step D comprises selectively reading out said representative phoneme waveforms and the parameters of the corresponding centroids from said waveform information storing means and correcting each of said read-out representative phoneme waveforms so that the envelope of its spectrum characteristic approaches the spectrum envelope represented by the parameter of said corresponding centroid; and said step E sequentially concatenates said corrected representative phoneme waveforms to generate a synthesized speech waveform.

14. The method of claim 13 or 11 wherein said representative phoneme correcting step comprises: LPC analyzing each of said representative phoneme waveforms to obtain an LPC parameter representing its spectrum envelope and subjecting said each representative phoneme waveform to Fourier Transform processing to obtain a spectrum characteristic $H_W(\omega)$; correcting said spectrum characteristic $H_W(\omega)$ so that its envelope approaches a spectrum envelope $S_r(\omega)$ of said centroid, by use of said spectrum envelope $S_r(\omega)$ represented by the parameter of said centroid; and subjecting the resulting corrected spectrum characteristic $H_r(\omega)$ to inverse Fourier Transform processing to obtain a corrected representative phoneme waveform.

15. The method of claim 14, wherein in said correcting step, when the distance between the LPC parameter of said representative phoneme waveform and the parameter of said centroid is smaller than a predetermined threshold value, the spectrum characteristic $H_W(\omega)$ of said representative phoneme waveform is corrected so that its envelope matches the spectrum envelope $S_r(\omega)$ of said centroid, by the following equation:

$$H_r(\omega)=H_W(\omega)*\{S_r(\omega)/S_W(\omega)\}$$

and when the distance between said parameters is larger than said threshold value, (a) the spectrum envelope represented by the parameter of said representative phoneme waveform is corrected with a fixed width smaller than said threshold value to obtain a corrected spectrum characteristic $H(\omega)$, (b) said corrected spectrum characteristic $H(\omega)$ is subjected to inverse Fourier Transform processing to reproduce a corrected representative phoneme waveform, and (c) said steps (a) and (b) are repeated until the spectrum envelope corresponding to the parameter of said corrected representative phoneme waveform matches the spectrum envelope represented by the parameter of said centroid.

16. The method of claim 15, wherein said representative phoneme correcting step repeats a step of cutting out said representative phoneme waveform every integer multiple of a pitch period and making said correction to each cut-out waveform segment.

17. The method of claim 15, wherein said representative phoneme correcting step repeats a step of cutting out said representative phoneme waveform every integral multiple of a frame length and making said correction to each cut-out waveform segment.

18. The method of claim 12, 13, or 11, wherein said pre-classifying step includes a step of further classifying the phoneme waveforms into a plurality of clusters according to its pitch, storing the pitch frequency in said waveform information storing means in correspondence to each representative phoneme waveform and determining a desired pitch contour of a phoneme string of said speech to be synthesized, and said selectively reading out step reads out representative phoneme waveforms similar to phonemes in a text by selecting representative phoneme waveforms of the most similar combination of context phonemes and pitch of each phoneme in said text.

* * * * *